United States Patent [19]

Duncan

[11] Patent Number: 4,620,760

[45] Date of Patent: Nov. 4, 1986

[54] ELECTRICAL CONNECTORS

[75] Inventor: William C. W. Duncan, Northampton, England

[73] Assignee: Plessey Overseas Limited, Ilford, England

[21] Appl. No.: 690,528

[22] Filed: Jan. 11, 1985

[30] Foreign Application Priority Data

Jan. 12, 1984 [GB] United Kingdom ..... 8400760
Mar. 26, 1984 [GB] United Kingdom ..... 8407800

[51] Int. Cl.[4] ..... H01R 13/62

[52] U.S. Cl. ..... 339/45 M; 339/46; 339/70; 339/73

[58] Field of Search ..... 339/45, 46, 89, 90, 339/DIG. 2, 186 M

[56] References Cited

U.S. PATENT DOCUMENTS

| | | | |
|---|---|---|---|
| Re. 31,462 | 12/1983 | McCormick et al. | 339/186 M |
| 3,312,928 | 4/1967 | Nava et al. | 339/46 |
| 3,808,579 | 4/1974 | Mina et al. | 339/46 |
| 4,279,458 | 7/1981 | Knapp | 339/45 M |
| 4,421,373 | 12/1983 | Ratchford et al. | 339/45 M |
| 4,472,013 | 9/1984 | Frear | 339/DIG. 2 |

FOREIGN PATENT DOCUMENTS

| | | | |
|---|---|---|---|
| 1232036 | 5/1971 | United Kingdom . | |
| 2069248 | 8/1981 | United Kingdom | 339/DIG. 2 |
| 2105923B | 4/1985 | United Kingdom . | |

*Primary Examiner*—Gil Weidenfeld
*Assistant Examiner*—David L. Pirlot
*Attorney, Agent, or Firm*—Fleit, Jacobson, Cohn & Price

[57] ABSTRACT

A quick release electrical connector comprises a plug part and a socket part. The socket part has an external screw thread and a coupling sleeve is captive on the plug part. Connected to the plug part is a number of internally screw threaded portions which are adapted to engage the screw thread on the socket part. The coupling sleeve has a surrounding axially movable retaining sleeve which in one position retains the screw threaded portions in engagement with the socket screw thread. In another position the retaining sleeve allows the screw threaded portions to move radially outwards out of engagement with the socket screw thread allowing quick separation of the plug and the socket part.

The connector includes a thrust washer to prevent relative rotation between the plug and the coupling sleeve in the event of vibrations causing inadvertent unscrewing of the socket part.

5 Claims, 12 Drawing Figures

ELECTRICAL CONNECTORS

FIELD OF THE INVENTION

This invention relates to electrical connectors, and in particular it relates to electrical connectors having a quick release screw coupling.

DESCRIPTION OF THE PRIOR ART

A previously proposed electrical connector consists of a plug and a socket wherein the plug has a plurality of elongate gripping members disposed on its periphery. The gripping members are hingedly attached to the plug at one end so that when the plug and socket are connected, the ends of the gripping members remote from the hinge can be made to grip the outer periphery of the socket by sliding an outer annular sleeve over the gripping members. When the plug and the socket are to be disconnected, the annular sleeve is slid axially so as to free the gripping members, which gripping members then spring outwardly thereby releasing the plug and socket. This type of connector has the disadvantage that it is bulky and complicated in design.

SUMMARY OF THE INVENTION

According to the present invention there is provided an electrical connector which comprises a socket part and a plug part, wherein, one of the parts has screw thread means on its outer surface and the other of the parts has a coupling sleeve captive thereon and wherein the coupling sleeve has an internal screw thread means which is complementary with the screw thread means of said one part, one of the screw thread means being defined by a plurality of radially movable parts which are disposed circumferentially within the connector to engage the other of the screw thread means, the radially movable parts being slidably located in circumferentially disposed apertures, the connector including a retaining sleeve which is movable relative to the movable parts, which retaining sleeve, when moved into one position, restrains the movable parts from sliding so that they engage the other screw thread means when the plug part and the socket part are connected, and when moved into another position allows the movable parts to slide away from the other screw thread means, thereby enabling the plug part and the socket part to be disconnected.

The coupling sleeve is preferably of annular cross section and may be captive on said other part so that it is rotatable about the longitudinal axis of said other part. However, a thrust washer may be disposed between the coupling sleeve and the other part which thrust washer is provided with a ratchet means operative to permit rotation of the coupling sleeve in one direction with a lower torque than that required to effect rotation of the coupling sleeve in the opposite direction. The thrust washer thereby acts as an anti-vibration locking device which eliminates or at least reduces the possibility of the coupling sleeve rotating and causing the connector to become disengaged due to vibration. The aforesaid thrust washer with ratchet means could also be embodied in other connectors so as to prevent or resist uncoupling of respective relatively rotatable parts.

The movable parts may be operatively associated with the coupling sleeve and captive therein. The movable parts may be arranged to lie equiangularly about the longitudinal axis of the connector so that they define the internal screw thread means of the other part and engage roots of adjacent threads of the other thread means.

The movable parts themselves may be in the form of elongate members which extend radially within the connector and may be rounded at either or both ends and each may be provided with a flange which engages with a seat on the coupling sleeve which limits the distance of travel of the sliding part in a radial direction.

The movable parts may alternatively be in the form of arcuate segments lying equiangularly about the longitudinal axis of the connector. In this case each of the arcuate segments is preferably provided with one or more projections on its inwardly curved surface, which projections are preferably in the form of part of a helical thread. The helical threads of the movable parts together make up the internal screw thread means. The outwardly curved surface of the movable parts is also provided with one or more projections or ribs which butt against the retaining sleeve when in said one position. The coupling sleeve has circumferentially extending apertures which have at least one pair of opposite sloping sides. The arcuate segments have corresponding sloping sides which co-operate with the sloping sides of the coupling sleeve to limit inward radial movement of the segments within the connector.

The retaining sleeve may be of an annular cross section and may be provided with one or more recesses or holes suitable for receiving one end of the movable parts, or for receiving the one or more projections or ribs of the arcuate segments, so that when the retaining sleeve is moved into the said another position, the movable parts can move radially outwardly to permit disconnection of the connector.

Alternatively, the retaining sleeve may be provided with a helical recess for receiving the elongate movable parts, which helical recess corresponds to the helical arrangement of the elongate movable parts.

The retaining sleeve may be urged to rest at the one position by means of a spring. The spring may be positioned between the coupling sleeve and the retaining sleeve.

The coupling sleeve may include a flange which, when the two parts are disconnected, is sandwiched between a stop and a spring washer on said other part, whereby the spring washer urges said other part towards said one part when the two parts are connected together.

So that electrical connector pins of the plug part can be aligned to enable correct pins engage with intended sockets of the socket part, the connector may be provided with an indexing means.

The indexing means may be in the form of a guide for example, which projects at a point on the periphery of the one part, which guide corresponds with a recess in the periphery of the other part.

The retaining sleeve may be attached to a lanyard thereby enabling the one part and the other part to be remotely separated, by pulling the lanyard, whereby the retaining sleeve slides into said another position, thereby enabling the movable parts to slide into the holes or recesses or helical recess provided in the retaining sleeve.

In a preferred embodiment of the present invention, the one part corresponds to the socket part and the other part corresponds to the plug part.

Embodiments of the present invention provide connectors which are compact and which facilitate rapid and reliable decoupling of screw coupled parts. Further, the simple construction of such connectors increases their reliability during use under adverse conditions such as icing.

BRIEF DESCRIPTION OF THE DRAWINGS

The invention will now be described, by way of example, with reference to the accompanying drawings in which.

Figure 9:
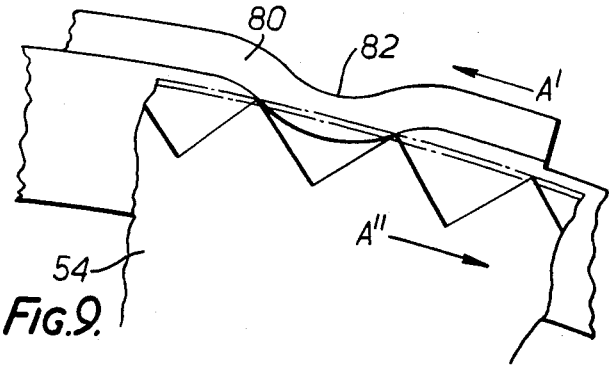
Figure 10:
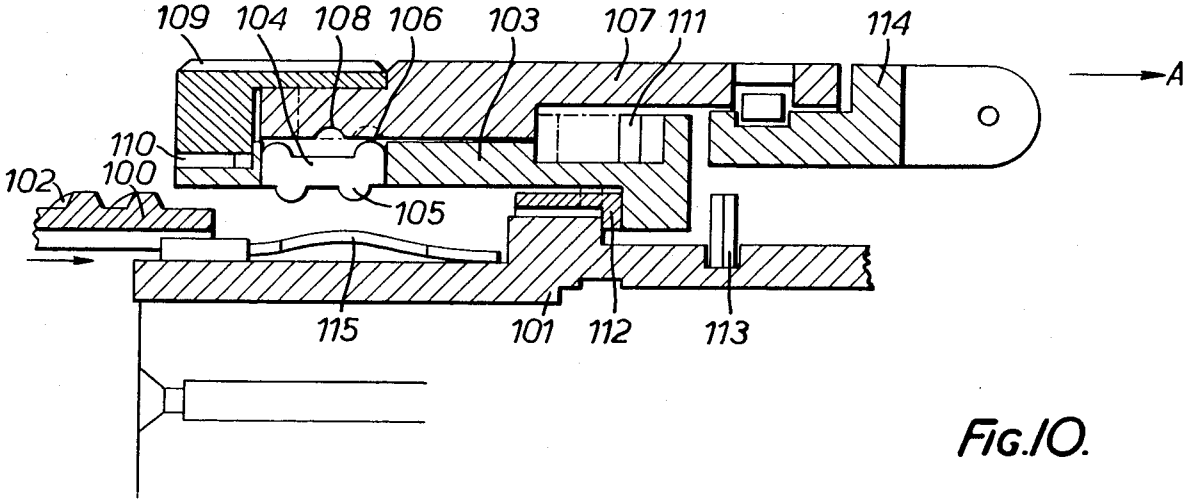

FIGS. *7a* and *7b* show a spring for positioning between the coupling sleeve and the retaining sleeve;

FIGS. *8a* and *8b* show a thrust washer provided with a ratchet means;

FIG. 9 shows an enlarged portion of an arm of the thrust washer in engagement with the plug part; and FIG. 10 is a part sectional view of a third embodiment of the present invention.

DETAILED DESCRIPTION

Figure 1:
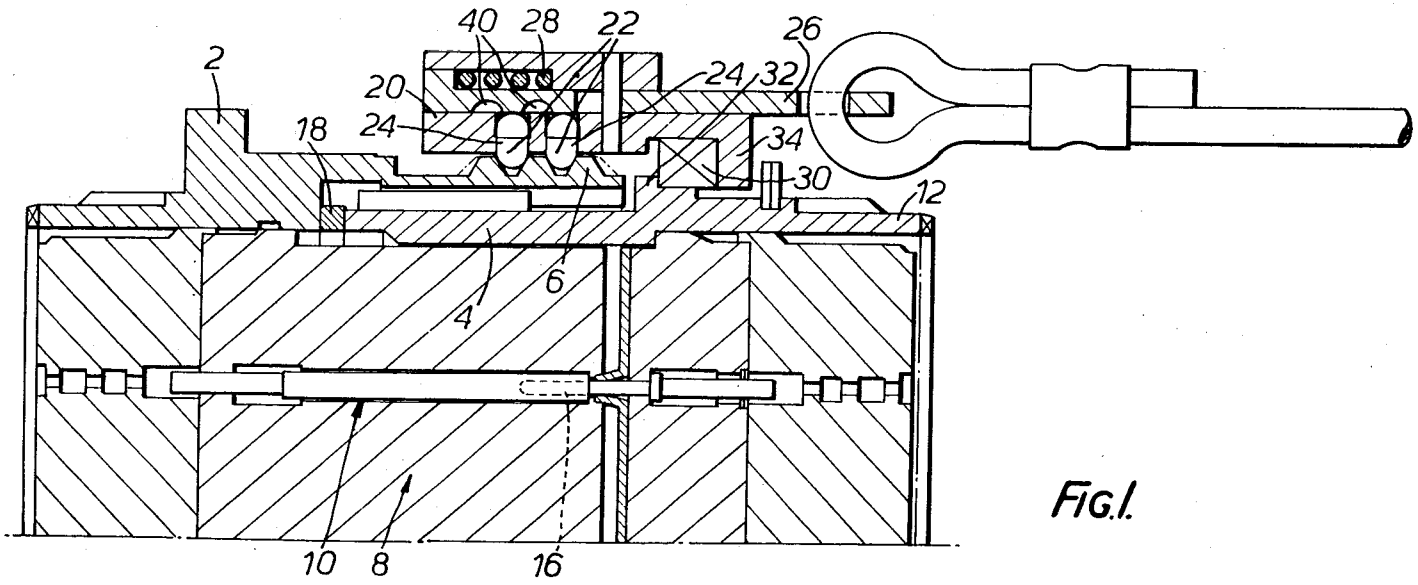
FIG. 1 shows a part sectional view of an embodiment of the present invention which comprises an electrical connector having a plug part and a socket part coupled together.

Referring firstly to FIG. 1, a connector is shown in which a socket part 2 and a plug part 4 are coupled together. The socket part 2 is of circular cross-section and has a screw thread means, in this case a helical screw thread 6, formed on its outer periphery at one end. The socket part 2 houses a moulded block 8 of insulating material, which block 8 provides support for a number of conductive socket elements 10. The plug part 4 comprises an inner shell 12 which is positioned within the socket part 2 and which houses a moulded block 14 of insulating material. The block 14 supports electrical connector pins 16 corresponding to the conductive socket elements 10 of the socket part 2. As shown in FIG. 1, the electrical pins 16 are received by the conductive socket elements 10 thereby effecting electrical connection between the socket part 2 and the plug part 4. A rubber sealing gasket 18 is provided on the inner surface of the socket part 2 to provide a seal between the socket part 2 and the plug part 4 when they are coupled together.

A coupling sleeve 20 is captive on the outer surface of the plug part 4 and has an internal screw thread means 22 which is defined by a plurality of elongate movable or sliding parts 24 having hemispherical ends. The sliding parts 24 are slidably located in radially extending apertures formed in the coupling sleeve 20 and they define a helical path which corresponds to the helical screw thread 6. The radially inward ends of the sliding parts 24 engage roots of the helical screw thread 6 when the socket part 2 and the plug part 4 are connected. The radially outward ends of the sliding parts 24 butt against a retaining sleeve 26 which is slidably mounted on the coupling sleeve 20. Hence, when the retaining sleeve 26 is in the position shown in FIG. 1, the sliding parts 24 are restrained from sliding radially outwardly. The retaining sleeve 26 is urged to rest at this position by means of a spring 28, for example a compression spring, located between the coupling sleeve 20 and the retaining sleeve 26.

A spring washer 30 is sandwiched between a stop 32 formed on the outer periphery of the inner shell 12, and a flange 34, which flange forms part of the coupling sleeve 20. The spring washer 30 urges the socket part 2 towards the plug part 4 when the two parts are coupled together. This arrangement enables the coupling sleeve 20 to be captive on the plug part 4 so that it is free to rotate about the longitudinal axis of the connector. It will be appreciated that the foregoing arrangement is such that the coupling sleeve 20 can be screwed on to or off the socket part 2 by rotating the coupling sleeve about the longitudinal axis of the connector in the appropriate direction. Hence, when the socket part 2 and the plug part 4 are to be connected, it is clear that the coupling sleeve 20 can be screwed on to the socket part 2 thereby causing the spring washer 30 to urge the inner sleeve 12 towards the socket part 2 so that the end of the inner sleeve 12 butts up against the rubber sealing gasket 18.

Figure 2:
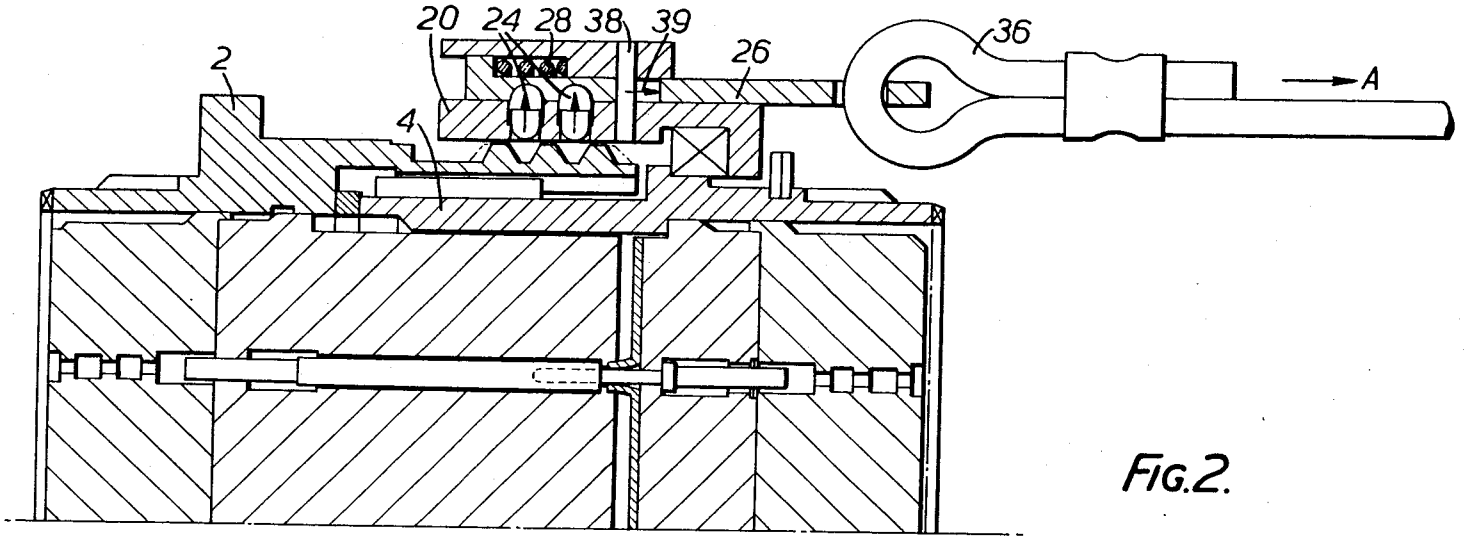
FIG. 2 shows a part sectional view of the electrical connector of FIG. 1 wherein the plug part and the socket part are partly disconnected.

Referring now to FIG. 2, disconnection of the socket part 2 and the plug part 4 of the connector will be described. A lanyard 36 is attached to the retaining sleeve 26 in the manner shown. When a force is exerted on the lanyard 36 in the direction of arrow A the retaining sleeve 26 slides, relative to the coupling sleeve 20 and the sliding parts 24, in the direction of arrow A against the action of the spring 28. The distance of travel of the retaining sleeve 26 is limited by means of a retaining pin 38 which passes through an elongate hole 39 in the retaining sleeve 26, which hole 39 defines the distance through which the retaining sleeve 26 may be moved. As can be seen in FIG. 2, the retaining sleeve 26 has been moved in the direction of arrow A so that one end of the hole 39 butts up against the pin 38, and a helical recess 40, formed in the retaining sleeve 26 (shown in FIG. 1 as a pair of semi-circular recesses), is located adjacent to the sliding parts 24. The sliding parts 24 are then free to slide radially outwardly when made to do so by shearing forces (due to the exertion of the force on the lanyard 36) between the hemispherical ends of the sliding parts 24 and the side of the helical screw thread 6. As a result of this operation, the sliding parts 24 slide away from the helical screw thread 6 and the radially outward hemispherical ends are received by the helical recess 40, thereby enabling the plug part 4 and the socket part 2 to be disconnected.

Figure 3:
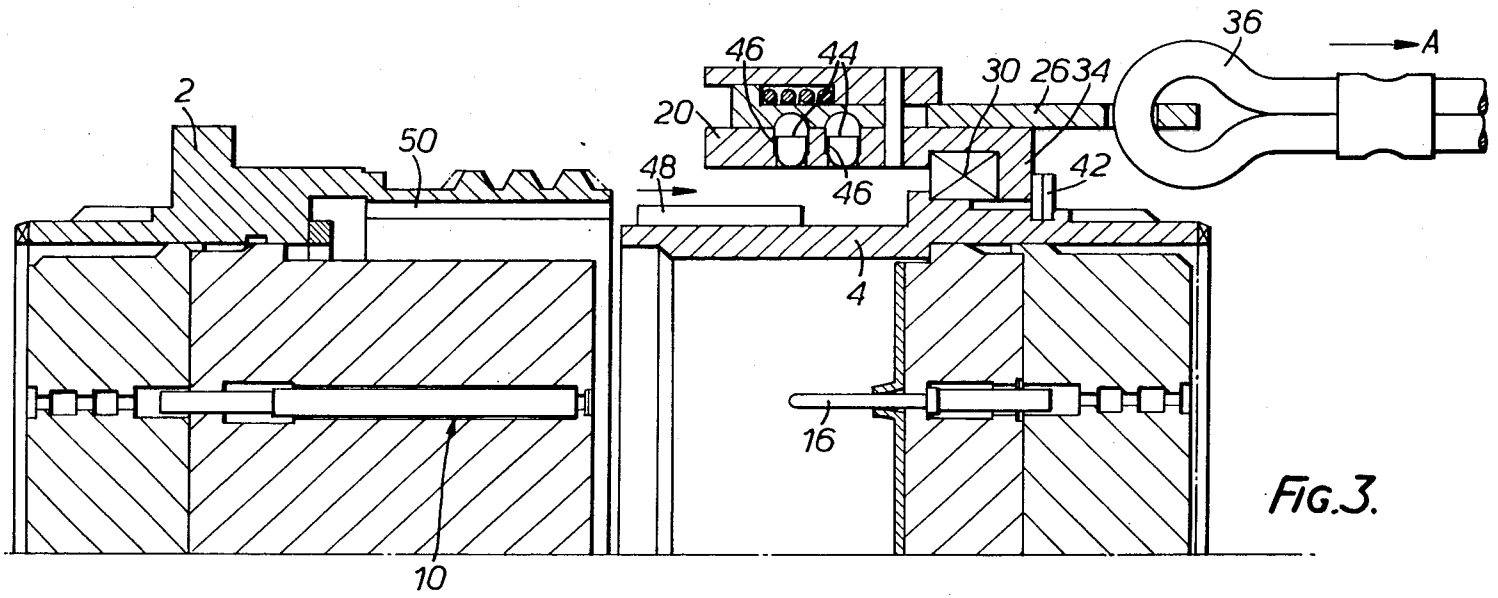
FIG. 3 shows a part sectional view of the electrical connector of FIGS. 1 and 2 wherein the plug part and the socket part are disconnected.

Referring now to FIG. 3, the socket part 2 and the plug part 4 are shown to be disconnected, but a force is still being exerted on the lanyard 36 so that the retaining sleeve 26 remains in the appropriate position for disengagement of the socket part 2 and the plug part 4. Due to the separation of the socket part 2 and the plug part 4, the spring washer 30 expands and so causes the flange 34 of the coupling sleeve 20 to butt up against a retaining ring 42 located on the outer periphery of the inner shell 12, thereby preventing the coupling sleeve 20 from becoming detached from the inner shell 12.

So that the sliding parts 24 do not fall out of the coupling sleeve 20, when the plug part 4 and the socket part 2 are disconnected, the sliding parts 24 are each provided with a flange 44 which can engage with a seat 46 located in respective radially extending apertures.

The connector is provided with an indexing means so that the electrical pin 16 of the plug part 4 can be aligned with correct socket elements 10 of the socket part 2 when the two parts are to be connected. The indexing means comprises a guide 48 which projects from the periphery of the plug part 4, and a recess 50 situated on the periphery of the socket part 2, which recess 50 receives the guide when the two parts are coupled together.

It will be understood that although the coupling sleeve 20 and the sliding parts 24, of the above described arrangement, form a part of the plug part 4, alternative arrangements can be envisaged without departing from the scope of the present invention, for example, one in which the coupling sleeve and sliding parts are located on the socket part.

Figure 4:
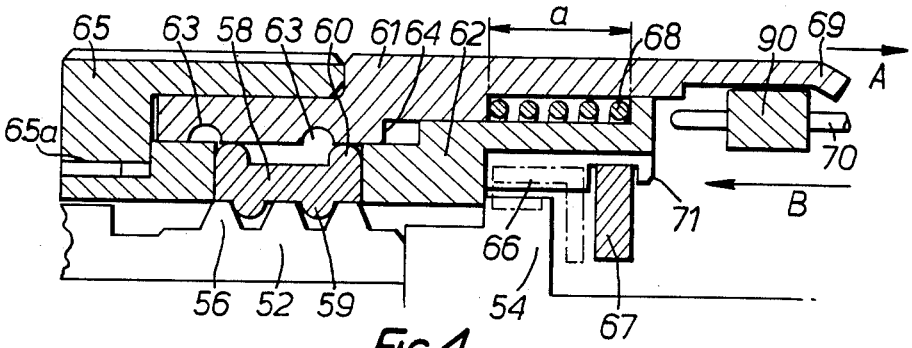
FIG. 4 shows a part sectional view of a second embodiment of the present invention.

Referring now to FIG. 4, a part sectional view of electrical connector according to a second embodiment of the present invention is shown. The electrical connector comprises a socket part 52 and a plug part 54 shown connected together. The socket part 52 has an external screw thread 56 on its outer periphery.

A coupling sleeve 62 is captive on the outer surface of the plug part 54 and has an internal screw thread means which is defined by six arcuate movable parts 58 having projections 59 on their inwardly curved surface. The projections 59, which although shown as having a hemispherical cross section may alternatively be trapezoidal in cross section, form part of a helical thread. The projections 59 of the six movable parts 58 together make up a double thread having a triple thread start. The movable parts 58 also have projections 60 on their outwardly curved surface. In this embodiment, the projections 60 are in the form of a pair of annular ribs which butt against a retaining sleeve 61 when the socket part 52 and the plug part 54 are connected together.

Each of the arcuate segments 58 is disposed in a circumferentially extending aperture in the coupling sleeve 62. The retaining sleeve 61 is mounted on the outer surface of the coupling sleeve 62 and is slidable relative thereto in a direction parallel to the longitudinal axis of the connector and is rotatable about the longitudinal axis of the connector. The retaining sleeve 61 has a pair of recesses 63 which correspond to the projections 60 of the arcuate segments 58. Hence, when the retaining sleeve 61 is slid in the direction of an arrow A, a face 64 of the retaining sleeve 61 butts up against a corresponding edge of the coupling sleeve 62, and the recesses 63 are then in such a position that the recesses 63 can receive the projections 60 thereby enabling the socket part 52 and the plug part 54 to be disconnected in a similar manner to that described with reference to the first embodiment.

The retaining sleeve 61 is located in a radial direction by means of an end cap 65 which is screwed and locked to the coupling sleeve 62 by means of a screw thread 65*a*. The outer circumferential surface of the end cap 65 is knurled thereby facilitating an improved hand gripping surface.

A spring 68 (to be described in further detail later) is disposed between the retaining sleeve 61 and the coupling sleeve 62. The spring 68 urges the retaining sleeve 61 towards the position shown in FIG. 4 so that in the absence of a force in the direction of the arrow A, the retaining sleeve 61 restrains the arcuate segments 58 from moving radially outwardly and hence the electrical connector remains connected.

A thrust washer 66 (to be further described later) is located between the coupling sleeve 62 and the plug part 54. The thrust washer is provided with a ratchet means operative to permit rotation of the coupling sleeve 62 in one direction with a lower torque than that required to effect rotation of the coupling sleeve in the opposite direction.

A circlip 67 is located into a recess formed in the coupling sleeve 62, which circlip serves to secure the thrust washer 66, and the coupling sleeve 62 in position.

A lanyard attachment ring 90 is positioned within a radially inner surface of the retaining sleeve 61 as shown in FIG. 4. A lanyard 70 is fixed to the lanyard attachment ring 90. An end portion 69 of the retaining sleeve 61 is spun over so as to captivate the lanyard attachment ring 90 whilst allowing the retaining sleeve 61 to rotate relative to the ring 90. This ensures that the lanyard 70 always remains in the same attitude relative to the plug part 54.

Figure 5:
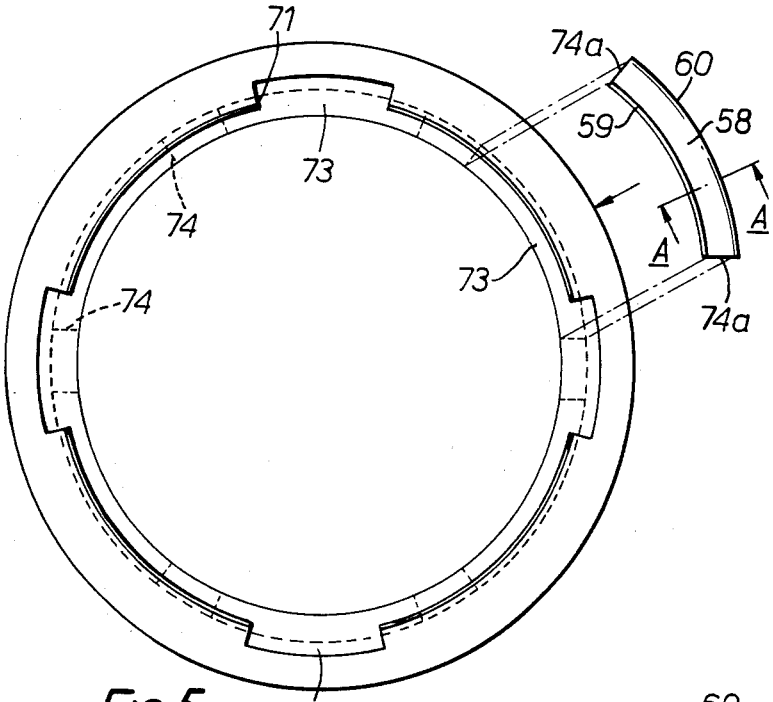
FIG. 5 shows an end view of a coupling sleeve of the second embodiment of FIG. 4.
Figure 6:
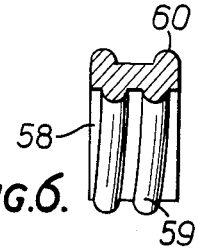
FIG. 6 shows a sectional view of an arcuate segment of the second embodiment taken along lines A—A of FIG. 5.

Referring now to FIG. 5, an end view of the coupling sleeve 62 is shown taken from the direction of an arrow B of FIG. 4. The coupling sleeve 62 has an inwardly directed flange 71 which has four slots 72 disposed along its circumference, which slots allow the thrust washer 66 and the circlip 67 to be put into position.

As can be seen from FIG. 5, the coupling sleeve 62 has six circumferentially extending apertures 73 which correspond in size to the arcuate segments 58. Each of the apertures 73 has a pair of opposite sloping sides 74 which cooperate with a pair of sloping sides 74*a* of the arcuate segment 58 so as to limit inward radial movement of the segment 58 when disposed within the apertures 73 of the coupling sleeve 62.

Figure 7A:
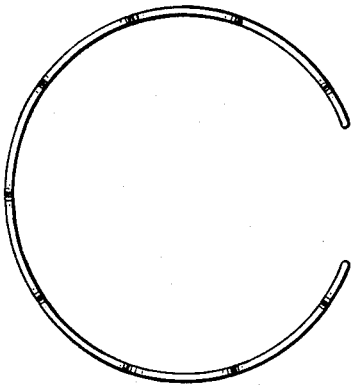
Figure 7B:
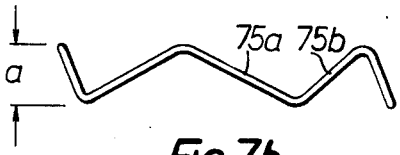

FIG. 7*a* shows a plan view and FIG. 7*b* shows a side elevational view of the spring 68. The spring 68 may be formed from, for example, piano wire and may consist of five lobes, each lobe having a pair of sloping surfaces 75*a* and 75*b* of different lengths. The length of the surfaces 75*a* and 75*b* of each lobe may vary from one lobe to another, but the height 'a' of the spring along its circumference preferably remains constant.

The above described arrangement has the advantage that the arcuate segments 58 for use therein can be manufactured more easily. For example, the segments 58 can be cut from an annular shaped brass ring after the projections 59 and 60 have been machined thereon. Manufacturing the arcuate segment 58 in this manner enables their thickness in a radial direction to be significantly reduced and hence the thickness of the coupling sleeve 62 can also be reduced. This results in an overall reduction in the overall radial dimension of the electrical connector.

The use of arcuate segments 58 has the advantage that twisting of the segments 58 within the apertures 73 is eliminated or at least reduced thereby increasing the life of the connector. Further, the risk of the segments 58 becoming jammed is eliminated or reduced.

By locating the lanyard attachment ring 90 on the radially inner surface of the retaining sleeve 61, unhampered hand access to the end cap 64 is possible thereby enabling the plug parts of the electrical connector to be secured onto the socket part 52 more easily. Further, by allowing relative rotation of the retaining sleeve 61 with respect to the lanyard attachment ring 68, the lanyard 70 is prevented from becoming tangled with the cable of the plug part 54.

By forming the projections 59 in the form of a double thread with a triple thread start enables the plug part 54 to be connected to the socket part 52 with less than 180° turn by hand.

Figure 8A:
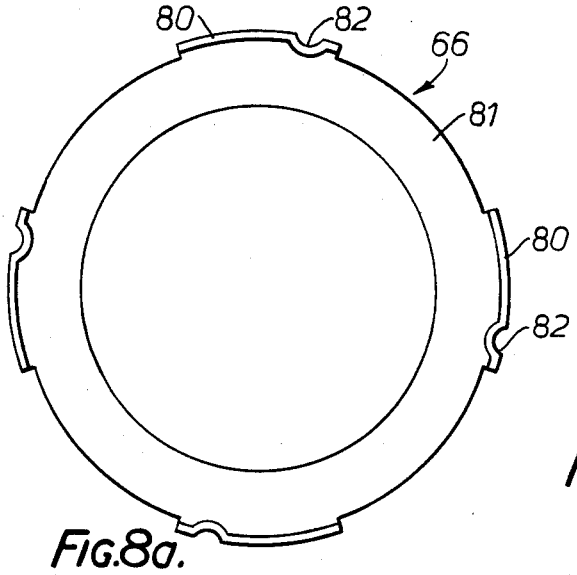
Figure 8B:
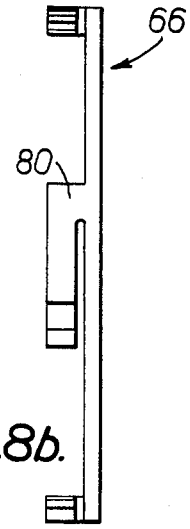

FIGS. 8*a* and 8*b* respectively show end and side elevational views of the thrust washer 66. Elongate arms 80 are located around the outer periphery of an annular base 81 to form a ratchet means. Each arm 80 is attached to the annular base 81 at one end, and at the end remote from the attached end, there is disposed a restraining portion or detent 82. As can be seen from FIG. 8*a*, the restraining portion 82 is arcuate in shape and is formed integrally with the arm 80. Alternatively, the restraining portion 82 can be triangular in shape, the precise shape and size being determined by the torque characteristics required.

FIG. 9 shows an enlarged portion of one of the arms 80 when in contact with the plug part 54. The plug part 54 has a toothed edge on its outer edge which can be of the form shown in FIG. 9. When the spring washer 66 is in the position as shown in FIG. 4, the restraining portion 82 of the arms 80 engage with the toothed edge of the plug part 54. The arms 80 are received by the slots 72 of the coupling sleeve 62 and hence relative rotation between the thrust washer 66 and the coupling sleeve 62 is restrained.

If a torque is exerted between the plug part 54 and the coupling sleeve 62 so as to urge them to rotate in the directions of the arrows A′ and A″ in FIG. 9, the restraining portions 82 slide over the toothed edge since the torque exerts a tensile force in the arms 80. However, when the torque urges relative rotation in a direction opposite to arrows A′ and A″, a compressive force is exerted in the arms 80 and so relative rotation is resisted.

The spring washer 66 as described above has the advantage that the coupling sleeve 62 is prevented from uncoupling if the connector is subjected to vibration.

The arms 80 may be of differing lengths, thereby eliminating or reducing the number of resonant frequencies of vibration of the spring washer 66. The lengths of the arms 80 are preferably such that vibrations over a wide frequency range will not cause the coupling sleeve 62 to work loose.

The annular base 81 may also act as a spring shaped so as to urge the circlip 67 and the face of the plug part 54 apart.

Referring to FIG. 10, a part sectional view of an electrical connector according to a third embodiment of the present invention is shown. This embodiment is a modified version of the connector described with reference to FIG. 4. In this embodment, the connector comprises a socket part 100 and a plug part 101 shown disconnected. The socket part 100 has a screw thread 102 on its outer periphery.

A coupling sleeve 103 is captive on the outer surface of the plug part 101 and has an internal screw thread means which is defined by six arcuate movable parts 104 similar to the parts 58 described with reference to FIG. 4. The arcuate movable parts 104 have projections 105 on their inwardly curved surface which form part of a helical thread and are shaped to engage roots of the screw thread 102 when the parts of the connector are connected.

The movable parts 104 also have projections 106 on their outwardly curved surface. In this embodiment, the projections 106 are in the form of annular ribs which butt against a retaining sleeve 107 when the plug part 101 and the socket part 100 are connected. Each of the parts 104 is disposed in a circumferentially extending aperture in the coupling sleeve 103. The retaining sleeve 107 is mounted on the coupling sleeve 103 and is slidable relative thereto in a direction parallel to the longitudinal axis of the connector and is rotatable about the longitudinal axis of the connector. The retaining sleeve 107 has a single annular recess 108 corresponding to one of the projections 106. When the retaining sleeve 107 is slid in the direction of arrow A, the recess 108 can be moved into a position (as indicated by dotted lines) such that it can receive the projection 106 thereby enabling the socket and plug to be disconnected in a similar manner as that described with reference to the connector of FIG. 4.

By having one annular groove 108 instead of two as per the embodiment illustrated in FIG. 4, the movable part 104 can be situated further forward in the connector thereby enabling thread engagement to take place ahead of electrical connector engagement when the plug and socket are connected together.

The retaining sleeve 107 is located by means of an end cap 109 which is screwed and locked to the coupling sleeve 103 by means of a screw thread 110.

A return spring 111, in the form of a wave washer spring, is disposed between the retaining sleeve 107 and the coupling sleeve 103. The spring 111, which is equivalent to the spring 68 illustrated in FIG. 4, urges the retaining sleeve 107 towards the position shown in FIG. 10 so that in the absence of a force in the direction of the arrow A, the retaining sleeve 107 restrains the parts 104 from moving radially outwardly. In order to connect the plug 101 and the socket 100, the coupling sleeve 103 and the retaining sleeve 107 are rotated about the longitudinal axis of the connector so that when the helical thread 105 engages with the thread 102, the plug and socket are drawn together.

A thrust washer 112, equivalent to the washer 66 described with reference to FIGS. 8*a*, 8*b* and 9, is located between the coupling sleeve 103 and the plug part 101. The thrust washer 112 is provided with a ratchet means operative to permit rotation of the coupling sleeve 103 in one direction with a lower torque than that required to effect rotation of the sleeve in the opposite direction. The washer 112 therefore operates as an anti-vibration locking device which prevents the plug and socket unscrewing and becoming disconnected due to vibration.

A circlip 113 is located in a recess formed in the plug part 101, which circlip serves to secure the thrust washer 112, and the coupling sleeve 103 in position.

A lanyard attachment ring 114 is positioned within a radially inner surface of the retaining sleeve 107 as shown in FIG. 10. The ring 114 operates in a similar way to the ring 90 illustrated in FIG. 4.

A plurality of elongate continuity springs 115 are located on the periphery of the plug part 101 to provide electrical continuity between the plug 101 and the socket 100 when connected.

I claim:

1. An electrical connector comprising:

a plug part and a socket part;

a screw thread means on the outer surface of one of the parts;

a coupling sleeve captive on the other of the parts, wherein the coupling sleeve is of annular cross section and is rotatable about the longitudinal axis of the other of the parts, and the coupling sleeve comprises circumferentially disposed apertures in which radially slidable arcuate segments are located, the arcuate segments each have an outwardly curved surface provided with one or more projections or ribs, an inwardly curved surface provided with one or more projections in the form of part of a helical thread, and at least one pair of opposite sloping sides which co-operate with corresponding sloping sides of the circumferentially disposed apertures to limit inward radial movement of the arcuate segments within the connector;

a retaining sleeve which is movable relative to the arcuate segments, which retaining sleeve, when moved into one position, butts against the one or more projections or ribs on the outwardly curved surface of the arcuate segments and restrains the arcuate segments from sliding so that the projections on the inwardly curved surface of each of the arcuate segments engage the screw thread means when the plug part and the socket part are connected, and when moved into another position allows the arcuate segments to slide away from the screw thread means, thereby enabling the plug part and the socket part to be disconnected; and a thrust washer disposed between the coupling sleeve and said other of the parts, which thrust washer is provided with a ratchet means operative to permit rotation of the coupling sleeve in one direction with a lower torque than that required to effect rotation of the coupling sleeve in the opposite direction.

2. An electrical connector according to claim 1, wherein the retaining sleeve is of an annular cross section and is provided with one or more recesses for receiving the one or more projections of the arcuate segments, so that when the retaining sleeve is moved into the said another position, the movable parts can move radially outwardly to permit disconnection of the connector.

3. An electrical connector according to claim 2, wherein the retaining sleeve is urged to rest at the one position by means of a spring positional between the coupling sleeve and the retaining sleeve.

4. An electrical connector according to claim 3 wherein the connector is provided with an indexing means for enabling correct electrical connector pins of the plug part to be aligned with correct connector sockets of the socket part.

5. An electrical connector according to claim 4 wherein the retaining sleeve is attached to a lanyard thereby enabling the one part and the other part to be remotely separated, by pulling the lanyard, whereby the retaining sleeve slides into said another position, thereby enabling the movable parts to slide into the holes or recesses provided in the retaining sleeve.

* * * * *